United States Patent [19]

Hacikyan

[11] Patent Number: 4,779,343

[45] Date of Patent: Oct. 25, 1988

[54] CUTTING SHEARS

[76] Inventor: Mike H. Hacikyan, 16 Grove St.—Apt. #5, Westfield, N.Y. 14787

[21] Appl. No.: 34,533

[22] Filed: Apr. 6, 1987

[51] Int. Cl.[4] ..... B26B 13/00

[52] U.S. Cl. ..... 30/258

[58] Field of Search ..... 30/258, 254, 271, 186, 30/248

[56] References Cited

U.S. PATENT DOCUMENTS 2,766,526 10/1956 Pape ..... 30/258

4,602,432 7/1986 Vosbikian ..... 30/258

*Primary Examiner*—E. R. Kazenske

*Assistant Examiner*—Willmon Fridie Jr.

*Attorney, Agent, or Firm*—John J. Byrne

[57] ABSTRACT

A shearing device having one pivoting member formed of two metallic blades having their base ends spaced with one another and their lengths gradually approaching one another until their distal ends which are in engagement with one another and the inner edges of which are beveled to present cutting surfaces. A second cutting member is pivotally secured to said first member and is formed with a pair of cutting edges for cooperation with the two first-mentioned edges wherein a sheet of material placed therebetween is severed along two edges providing an opening rather than a slit.

5 Claims, 2 Drawing Sheets

CUTTING SHEARS

FIELD OF THE INVENTION

The invention relates to shears tor use by handicraft workers to form a cut opening in sheet material wherein the cutting members thereof are readily disconnected from one another and one member replaced with a blade of different width so as to cut openings of different widths.

OBJECTIVES OF THE INVENTION

A principal objective of this invention is to provide a shearing unit which has a multiplicity of inner cutting members which can be readily substituted, one for the other, depending on the size of the opening to be formed.

Another principal objective of this invention is to provide a pivot means which can be readily removed from the cutting members so that a second member can be replaced. The disconnect pivot means is so formed that a user can make the replacement without the need of any tools whatsoever.

Another objective of the invention is to provide a rugged and relatively inexpensive device which will permit the user to use a single set of shears rather than a set of shears for each width to be formed.

DESCRIPTION OF THE PRIOR ART

The prior art is aware of double edged cutting shears that cut a ribbon of material from sheet material. For instance, the U.S. Pat. No. 596,546 to Runyon discloses pivoting shears with a double cutting edge. The U.S. Pat. No. 47,250 to Carter also discloses a double cutting edge apparatus. However, in none of the prior art is the middle blade readily disconnected nor do the slot-forming blades taper to contact so that middle blades of varying width may be accepted within the assembly. The Piggott U.S. Pat. No. 1,208,202 is representative of shears having detachable cutting blades but not of the type described and claimed herein. Other references of some merit are:

U.S. Pat. No. 68,280; Binder; 1867
U.S. Pat. No. 170,658; Berridge; 1875
U.S. Pat. No. 306,758; Kenney; 1884
U.S. Pat. No. 1,812,350; Lingwood; 1931
U.S. Pat. No. 2,357,197; Hood; 1944

DETAILED DESCRIPTION OF THE INVENTION

Figure 7:
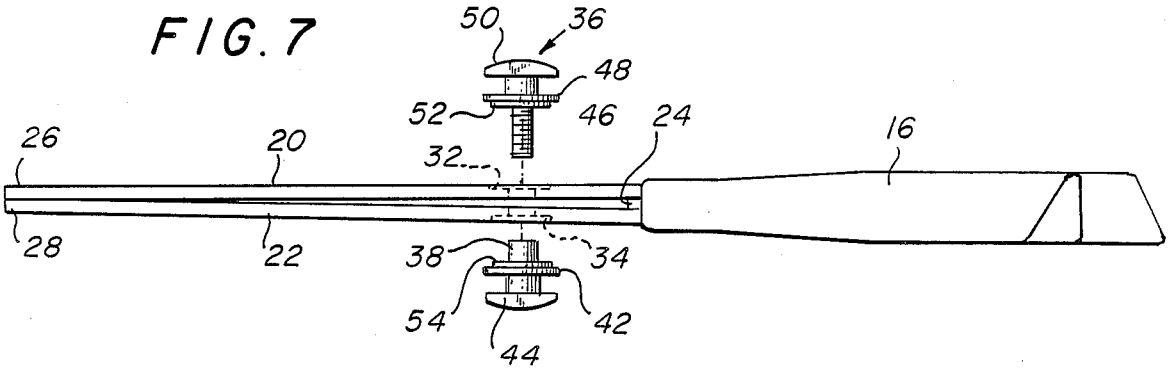
FIG. 7 is a top plan view of one handle member prior to the insertion of the center blade and showing the readily removable pivoting means in exploded position.

Referring now to the drawings wherein like elements indicate like parts, the numeral 10 refers to an assembled tool. The tool consists of a first cutting member 12 and a second cutting member 14. Cutting member 14 can best be seen in FIG. 7 wherein it can be seen that it is comprised essentially of a plastic handle 16 having a finger opening 18. Extending outwardly from the handle 16 is a pair of cutting blades 20 and 22 having inner ends embedded in handle 16 and and are spaced apart by a spacer 24 also embedded in the handle 18.

The blades 20 and 22 are conveniently made of a flexible stainless steel and are mounted in handle 18 in such a manner that they extend from the handle 18 and gradually taper into contact at their distal ends 26 and 28 to thereby define a gradually diminishing slot 30 therebetween. Intermediate their lengths the blades 20 and 22 are formed respectively with openings 32 and 34 for the reception of a readily disconnectable pivot or fulcrum generally indicated by the numeral 36.

The pivot 36 is comprised of a shank 38 having a threaded opening 40 therethrough. An abutment 42 is formed about the shank and is adapted to engage the side of blade 22. Spaced slightly away from abutment 42 along shank 38 is a finger lug 44.

Adapted to be received in the threaded opening 40 is a threaded screw 46. About threaded screw 46 is a circular abutment 48 which engages the side of blade 20. Outwardly spaced from the abutment 48 is a finger lug 50. The finger lugs 44 and 50 are provided so that the screw may be threaded into opening 40 without the need for any extra tools or the like. The abutments 42 and 48 are formed with thin circular projections 52 and 54, respectively. These projections are received in shallow counterbores in the outer surfaces of blades 20 and 22.

Figure 1:
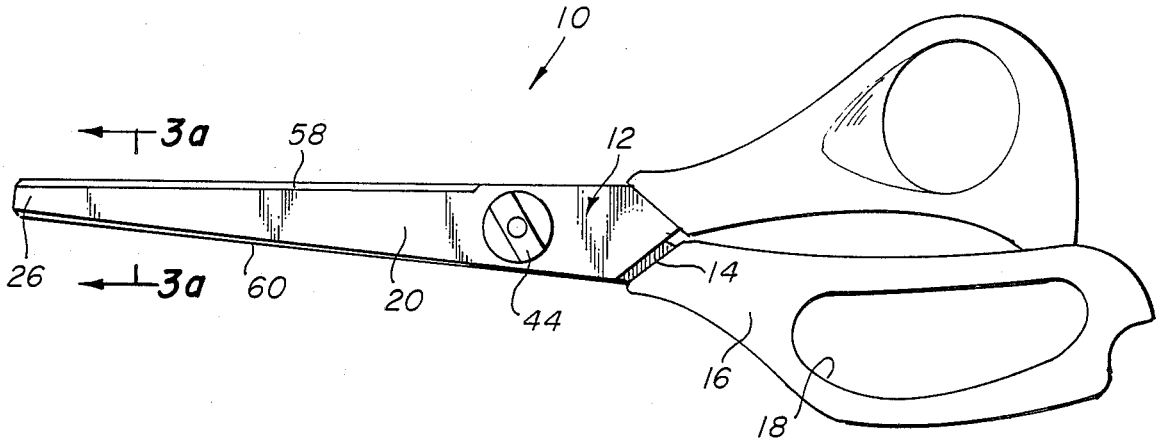
FIG. 1 is a side view of the tool in the closed position.
Figure 2:
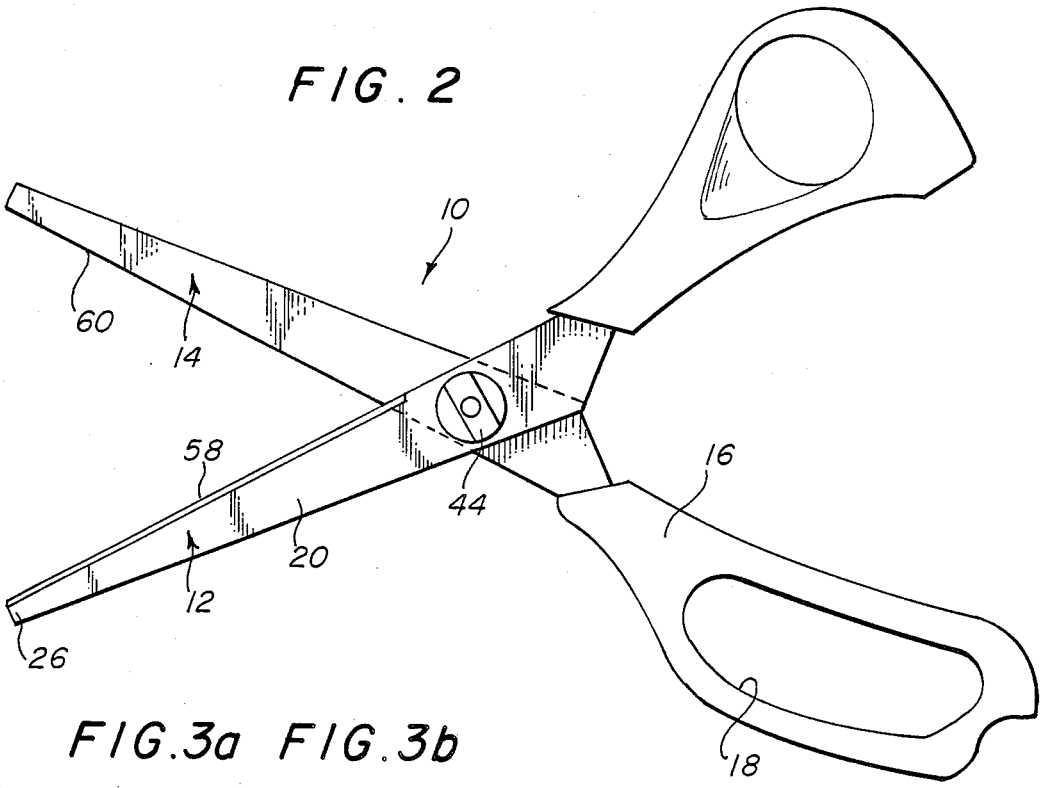
FIG. 2 is a view similar to FIG. 1 with the cutting edges pivoted to an open position.
Figure 8:
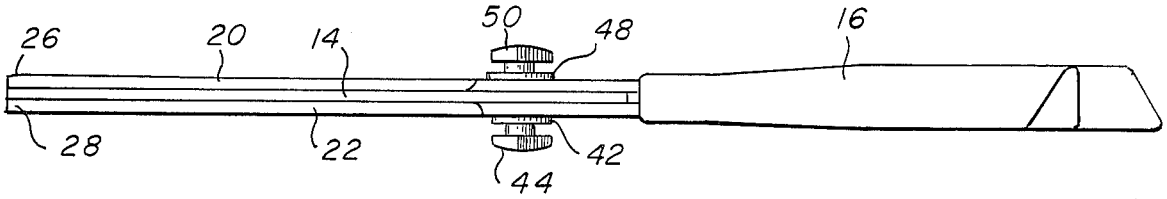
FIG. 8 is a view similar to FIG. 6 with the unit in assembled position.

The assembled unit can best be seen in FIGS. 2 and 8. FIG. 8 is a top plan view of FIG. 1 with the pivot means in engagement with the outer surfaces of blades 20 and 22. Note that blade 14 is disposed between blades 20 and 22 and separates the distal ends when the pivoting members 12 and 14 are closed. With the disposition of blade 14 therebetween the cutting edges are in general parallel relationship with one another.

Figures 3A, 3B:
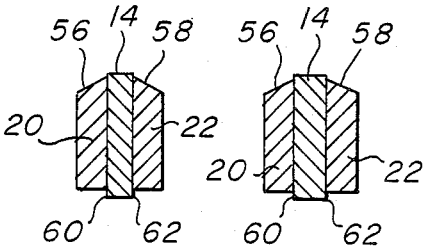
FIG. 3*a* is a cross-section along the line 3—3 of FIG. 1 with a center blade having a thin width.
FIG. 3*b* is a view along the line 3—3 of FIG. 1 with a center blade of greater width.

The blades 20 and 22 are beveled at 56 and 58 to provide sharpened edges that cooperate with the sharpened edges 60 and 62 of blade 14. This can best be seen in FIGS. 3*a* and 3*b*. The blade 14 is equipped with a flat, sharpened surface to cooperate with the sharpened edges of member 12. Because of the flexibility of the blades and the initial disposition of their distal ends in contact with one another, the cutting edges are maintained in close contact with one another as cutting members 12 and 14 are moved toward one another to a closed position. This results in an unusually neat opening.

Figure 5:
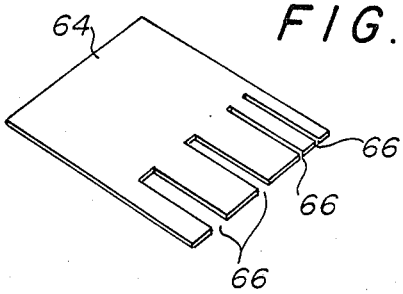
FIG. 5 is is a perspective view of a sheet material showing the different width of cuts that can be used by the tool of this invention.
Figure 6A:
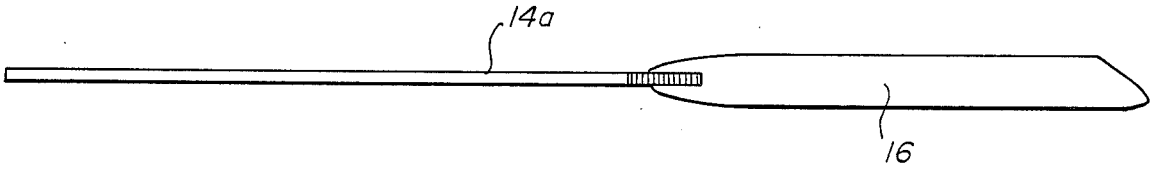
FIG. 6*a* is a top plan view of a center blade.
Figure 6B:
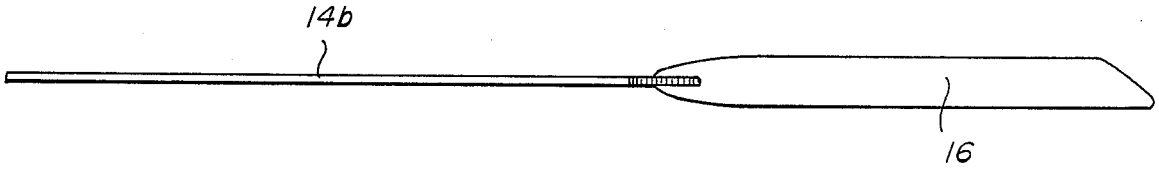
FIG. 6*b* is a top plan view of a center blade thinner than that shown in FIG. 6*a;*
Figure 4:
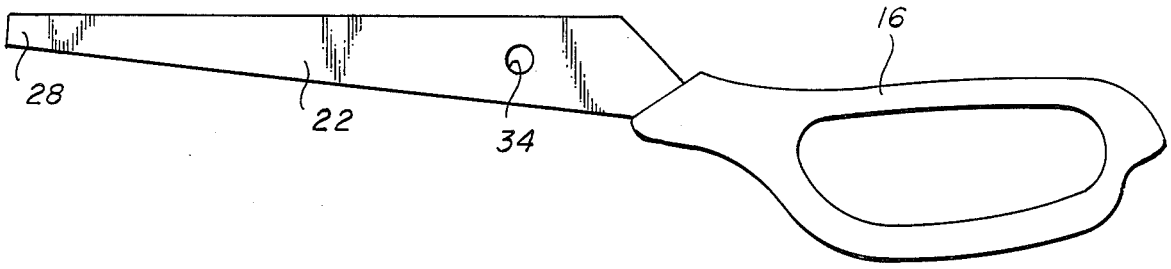
FIG. 4 is a side view of a center blade.

FIG. 5 discloses sheet material 64 with a variety of cuts. Referrring to FIGS. 6*a* and 6*b*, it can be seen that a plurality of blades 14 can be used with the double bladed member 12. Note in FIG. 6*a* that the width of blade 14*a* is substantially greater than the width of blade 14*b*. In all other respects the units are generally the same. Because of the rapid disconnect pivoting assembly 36, a user can readily unscrew the pivot member, take out one of the blades 14 and insert another blade 14 therefor, so that openings of different dimensions can be cut in the sheet material.

In the handicraft arts it is often desirable to make stencils of a type with varying widths. With the invention described herein, the kit user can make a variety of slots such as those shown by the numerals 64 and 66 by the mere interchange of the middle blade.

In a general manner, while there has been disclosed an effective and efficient embodiment of the invention, it should be well understood that the invention is not limited to such an embodiment as there might be changes made in the arrangement, disposition and form of the parts without department from the principle of the present invention as comprehended with the scope of the accompanying claims.

What is claimed is:

1. A tool for cutting sheet material comprising, a handle having a finger opening;

a first cutting member having a base end secured to said handle and extending outwardly to a first distal end;

a second cutting member having a second base end secured to said handle in spaced relationship to said first cutting member and extending outwardly to a second distal end;

said first and second members defining a slot that gradually decreases in width from said handle and is terminated by said first and second distal ends being in engagement with each other;

a second handle having a second finger opening;

a third cutting member extending outwardly from said second handle;

pivot means securing said third cutting member to said first and second members about a transverse axis located near said first and second handles so that said third member can move from an open position to a position within said slot by forcing said distal ends out of engagement whereby said third member is moved to a parallel relationship with said first and second members and in engagement with said first and second members throughout their lengths.

2. The tool of claim 1 wherein said first, second and third members are formed with openings along said axis and said pivot means comprise, a shaft extending through said openings about which said members can pivot and said shaft having an axial threaded opening therethrough;

an abutment formed on the exterior of said shaft engaging said member when said shaft is in said openings;

a screw for threaded engagement with said opening;

a second abutment for engagement with said second member as said screw is threaded into said threaded opening;

a finger lug formed exteriorly of said first abutment and a second finger lug formed exteriorly on said second abutment whereby said shaft and screw can be readily disconnected from one another whereby said third member can be readily replaced with a similar member of different thickness.

3. The tool of claim 1 wherein the surface area of said third member is slightly greater than the surface area of said first and second members.

4. The tool of claim 1 wherein said first and second members have first and second cutting edges formed on their adjacent surfaces and said third member has a pair of cutting edges formed on both sides thereof to cooperate with said first and second cutting edges.

5. The tool of claim 1 further comprising a fourth cutting member, interchangeable with said third cutting member, and having blade width greater than said third member.

* * * * *